US008207685B2

(12) United States Patent
Cheng et al.

(10) Patent No.: US 8,207,685 B2
(45) Date of Patent: Jun. 26, 2012

(54) LIGHT EMITTING DIODE (LED) DRIVER AND ASSOCIATED LED DRIVING METHOD

(75) Inventors: Ching-Chi Cheng, Hsintien (TW); Wen-Hsiang Chien, HsinTien (TW)

(73) Assignee: Advanced-Connectek Inc., Hsintien, Taipei County (TW)

( * ) Notice: Subject to any disclaimer, the term of this patent is extended or adjusted under 35 U.S.C. 154(b) by 276 days.

(21) Appl. No.: 12/696,615

(22) Filed: Jan. 29, 2010

(65) Prior Publication Data

US 2011/0025216 A1 Feb. 3, 2011

(30) Foreign Application Priority Data

Jul. 30, 2009 (TW) ..... 98125694 A

(51) Int. Cl.
*H05B 37/02* (2006.01)

(52) U.S. Cl. ..... 315/306; 315/185 R; 315/186

(58) Field of Classification Search ..... 315/185 R, 315/186, 200 R, 291, 297, 306, 307
See application file for complete search history.

(56) References Cited

U.S. PATENT DOCUMENTS 5,663,719 A 9/1997 Deese et al.
5,959,413 A * 9/1999 Komarek et al. ..... 315/306
6,969,807 B1 11/2005 Lin et al.
7,009,580 B2 3/2006 Leung
7,781,979 B2 * 8/2010 Lys ..... 315/185 S
2010/0308738 A1 * 12/2010 Shteynberg et al. ..... 315/185 R
2010/0308739 A1 * 12/2010 Shteynberg et al. ..... 315/193

* cited by examiner

*Primary Examiner* — Tung X Le
(74) *Attorney, Agent, or Firm* — Morris Manning & Martin LLP; Tim Tingkang Xia, Esq.

(57) ABSTRACT

The LED driver of the present invention comprises multiple LED arrays, at least one dividing diode, a power module, a driving module, at least one switch pair and a voltage sensing module. Each LED array comprises multiple LEDs connected in series. The dividing diode is mounted between adjacent LED arrays. The power module is connected to an external power source and forms a pulsating direct current (DC) voltage. The driving module receives the pulsating DC voltage outputs a constant current to the LED arrays. The voltage sensing module closes and opens the switch pairs that changes electrical configuration of the LED arrays. The LED driving method of the present invention comprises setting multiple voltage drops and at least one reference voltage; sensing an incoming voltage to compare with the reference voltage; and changing ways of connections of LED arrays based on the reference voltage and the incoming voltage.

6 Claims, 7 Drawing Sheets

LIGHT EMITTING DIODE (LED) DRIVER AND ASSOCIATED LED DRIVING METHOD

FIELD OF THE INVENTION

The present invention is a device driver and an associated LED driving method, particularly an LED driver capable of improving power efficiency.

BACKGROUND OF THE INVENTION

Light emitting diodes (LEDs) recently have become an indispensable lighting device due to their small size, fast lighting response and long life expectancy.

An LED is a diode (i.e. a semi-conductor element) and outputs light when appropriately energized. Generally, an LED emits light when subjected to a forward bias voltage greater than a threshold voltage ($V_{th}$) of the LED. The current rises sharply as the forward bias voltage increases beyond the threshold voltage ($V_{th}$). The brightness of the emitted light corresponds to the current through the LED.

However, in a general application, an alternating current (AC) LED device uses a current restrictor to restrict or limit current to a constant value and provides a constant and stable light output from the LED. Also, applying a constant current to the LED increases the LED lifetime.

With reference to FIG. 1, many patents about LED drivers exist. For example, U.S. Pat. No. 6,989,807, "LED driving device" discloses an "LED driving device (1)" that improves efficiency, power factor and power consumption by changing how many LEDs are lighted by an AC voltage. The "LED driving device (1)" comprises a power module (10), an LED array (13), multiple current controllers (11) and a voltage detector (12).

The LED array (13) comprises multiple LEDs connected in series. Each LED has an anode and a cathode.

The power module (10) is connected to an external power source and has a bridge rectifier. The external power source provides an alternating current (AC) power. The AC power is sinusoidal and has alternating negative and positive segments. The bridge rectifier inverts the negative segments of the AC to positive segments and forms a pulsating direct current (DC) voltage.

The LED array (13) is connected to the power module (10) and has multiple LEDs (131) connected in series.

The current controllers (11) are connected respectively to the cathodes of the LEDs (131).

The voltage detector (12) is connected to the power module (10) and the current controllers (11). The voltage detector (12) senses the pulsating DC voltage of the power module (10) and controls the current controllers (11) to turn the LEDs (131) ON or OFF based on the sensed pulsating DC voltage.

Accordingly, the LED driver selectively drives a certain number of LEDs at different voltage levels of the pulsating DC voltage. However, the LED driver is able to drive some LEDs at a very low AC voltage level. Those LEDs that have not been driven are idle, and the overall efficiency of the LED driver is reduced. Therefore, an efficient method of driving all LEDs for every AC voltage level is required.

SUMMARY OF THE INVENTION

The objective of the present invention is to provide an LED driver and a LED driving method that drive all LEDs at different AC voltage levels to achieve highest performance of an LED device.

The LED driver in accordance with the present invention comprises multiple LED arrays, at least one dividing diode, a power module, a driving module, at least one switch pair and a voltage sensing module. Each LED array comprises multiple LEDs connected in series. The dividing diode is mounted between adjacent LED arrays. The power module is connected to an external power source and inverts negative segments of AC to positive segments to form a pulsating direct current (DC) voltage. The driving module receives the pulsating DC voltage from the power module and outputs a constant current to the LED arrays. The voltage sensing module senses the pulsating DC voltage and closes and opens the switch pair that changes electrical configuration of the LED arrays. Thus, the present invention is capable of driving all LEDs at different AC voltage levels.

The LED driving method in accordance with the present invention comprises acts of initialization, sensing voltage and changing electrical configuration. The act of initialization sets multiple voltage drops and at least one reference voltage. The voltage drop is a driving voltage of an array of LEDs. The reference voltage is corresponding to adjacent voltage drops. The act of sensing voltage senses an incoming voltage to compare with the reference voltage. The act of changing electrical configuration changes ways of LEDs connected based one the reference voltage and the incoming voltage, which makes the incoming voltage higher than the driving voltage of an array of LEDs.

BRIEF DESCRIPTIONS OF THE DRAWINGS

FIG. 1 is a circuit diagram of an LED driver presented in U.S. Pat. No. 6,989,807;

DETAILED DESCRIPTION OF THE PRESENT INVENTION

Figure 1:
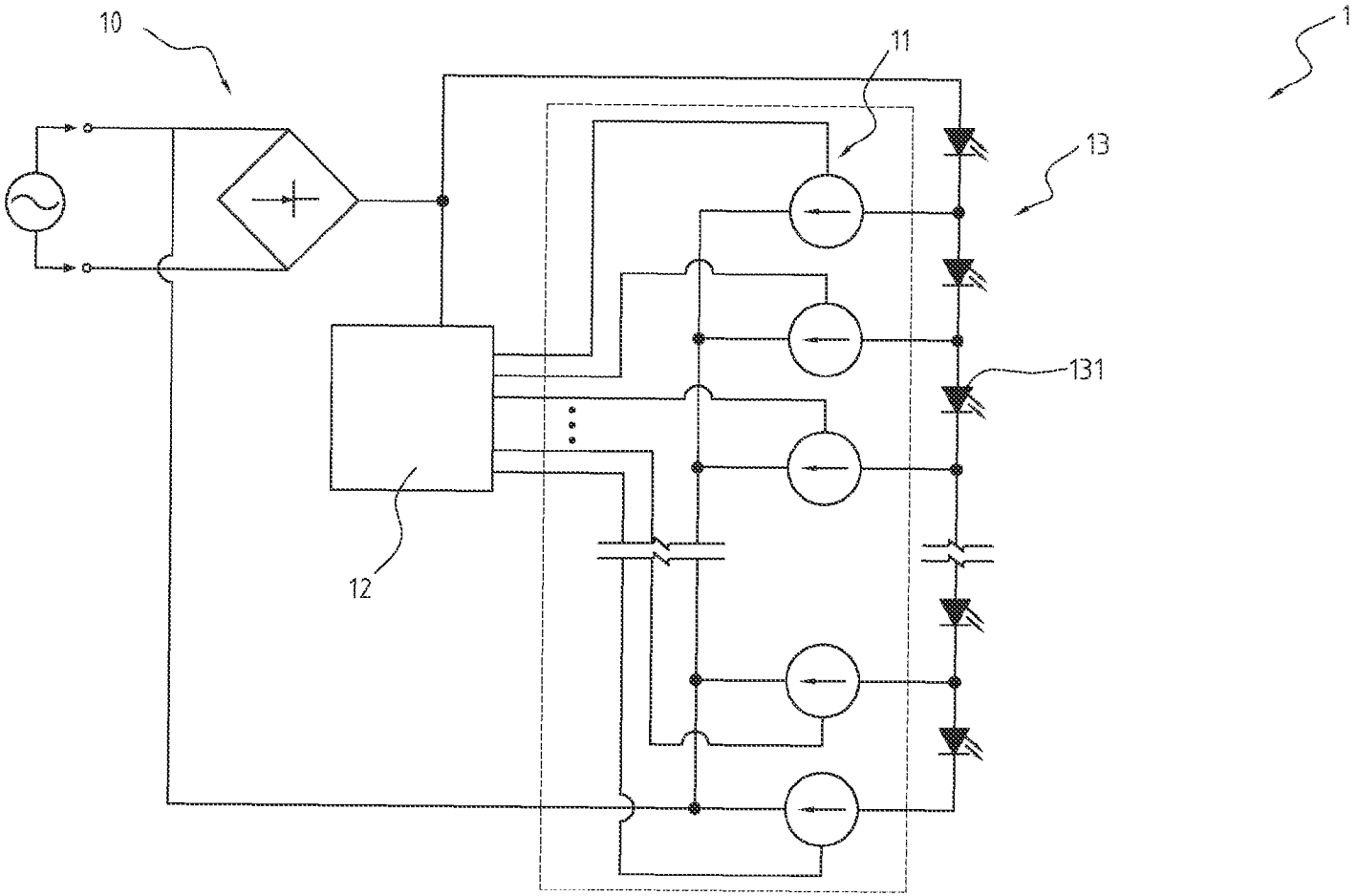
Fig. 1 (Prior Art)
Figure 2:
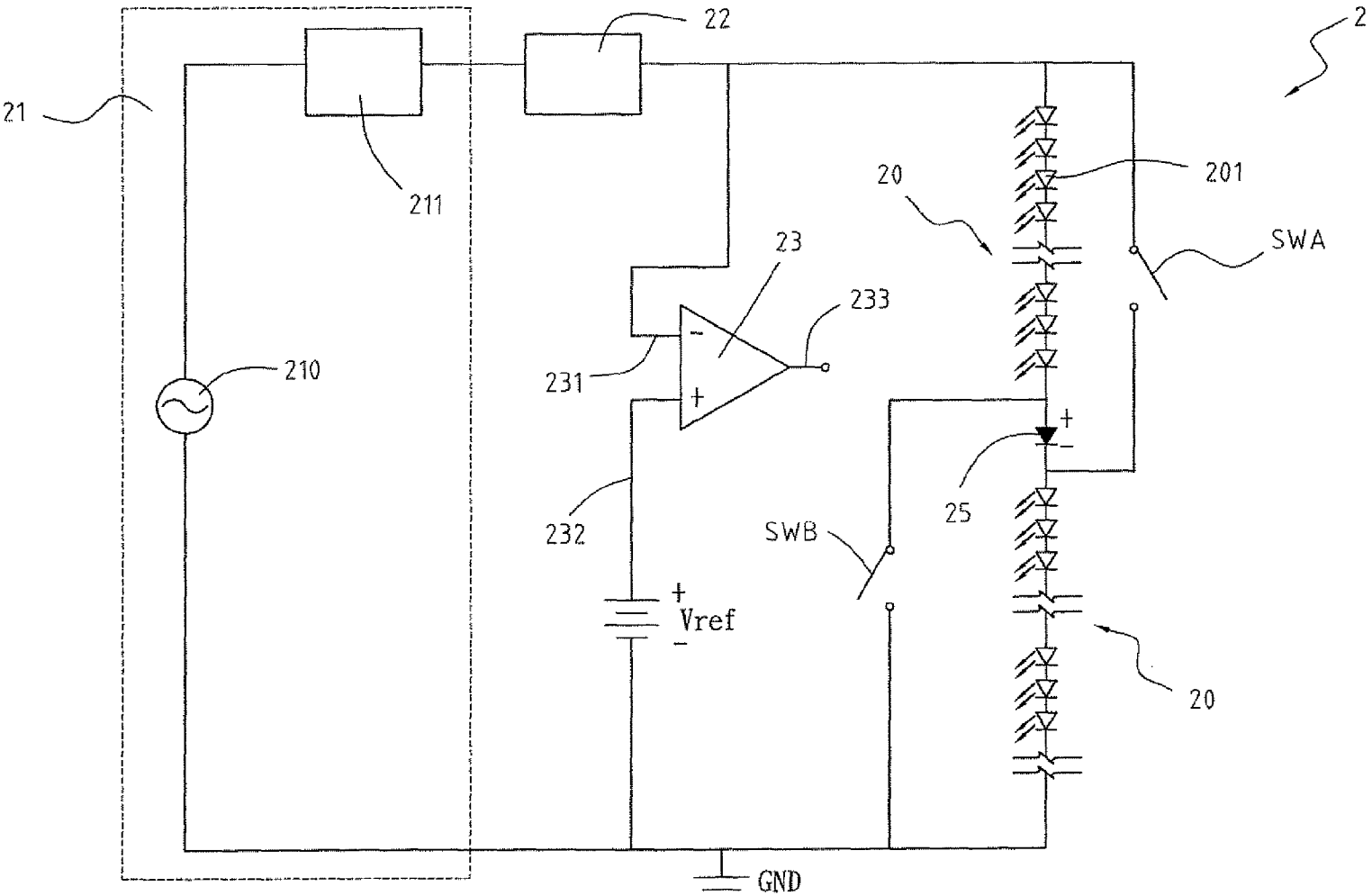
FIG. 2 is a circuit diagram of a first embodiment of an LED driver in accordance with the present invention.
Figure 3:
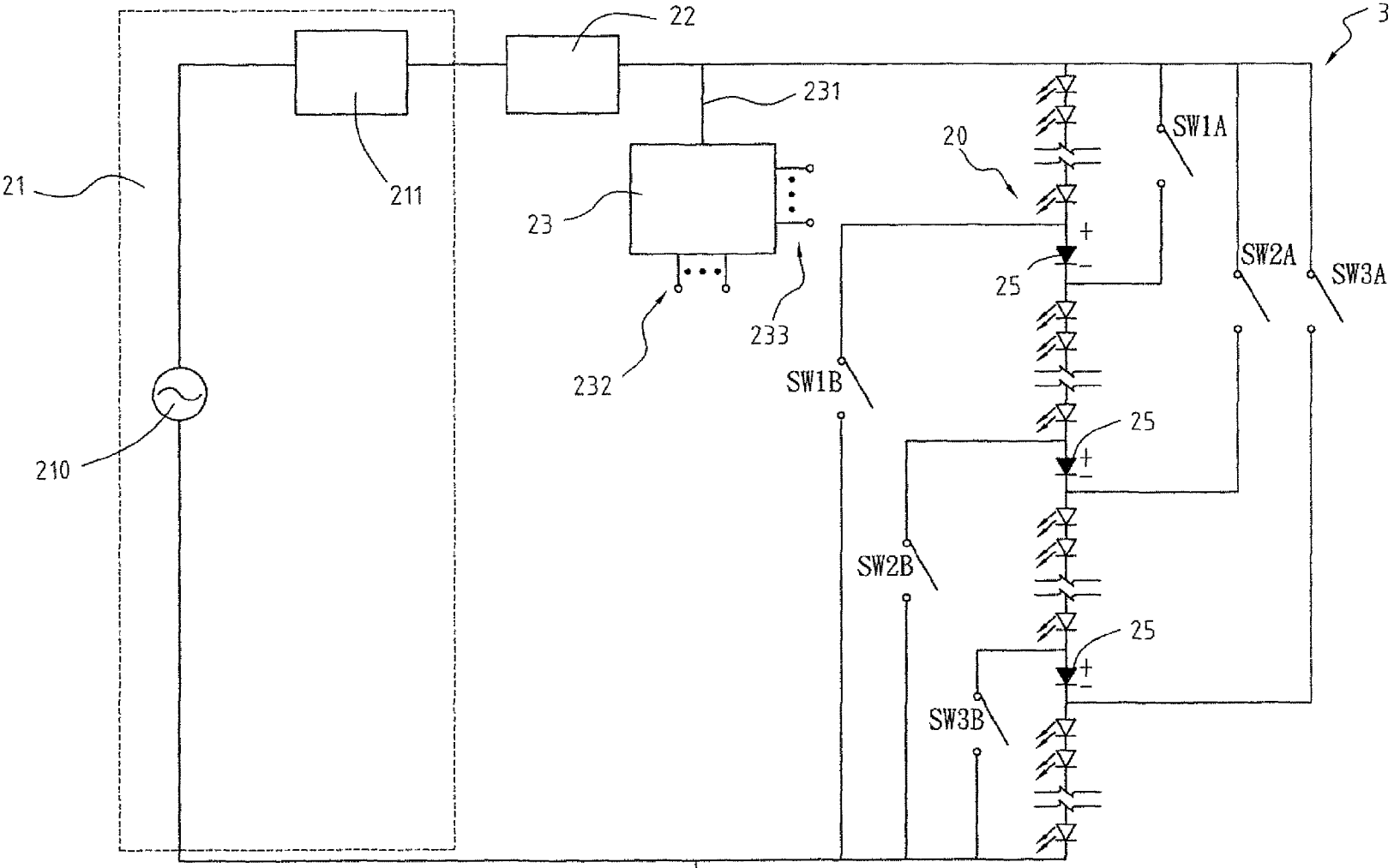
FIG. 3 is a circuit diagram of a second embodiment of the LED driving device in accordance with the present invention.

With reference to FIGS. 2 and 3, an LED driving device (2, 3) in accordance with the present invention comprises a ground (GND), multiple LED arrays (20), at least one dividing diode (25), a power module (21), a driving module (22), at least one switch pair and a voltage sensing module (23).

Each LED array (20) comprises multiple LEDs (201) connected in series. Each LED (201) has a threshold voltage.

The at least one dividing diode (25) is mounted between adjacent LED arrays (20) and has an anode and a cathode that allows current to flow only from the anode to the cathode.

The power module (21) is connected to an external power source (210) providing alternating current (AC) power and has a rectifier (211). The AC power is sinusoidal and has alternating negative and positive segments. The rectifier (211) inverts the negative segments of the AC power to positive segments that forms a pulsating direct current (DC) voltage.

The driving module (22) is connected to the power module (21), receives a pulsating DC voltage from the power module (21) and outputs a constant current to the LED arrays (20). The driving module (22) may be a current restrictor.

Figure 4:
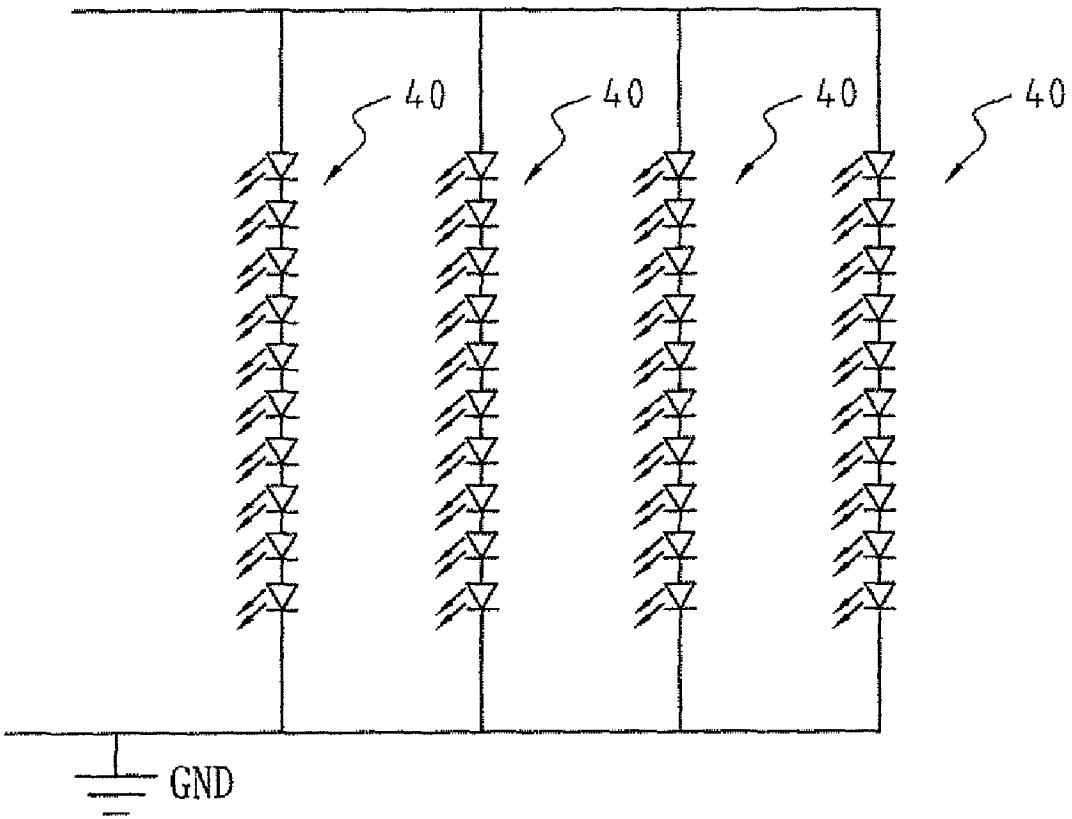
FIG. 4 is a circuit diagram of four sets of LED array connected in parallel.
Figure 5:
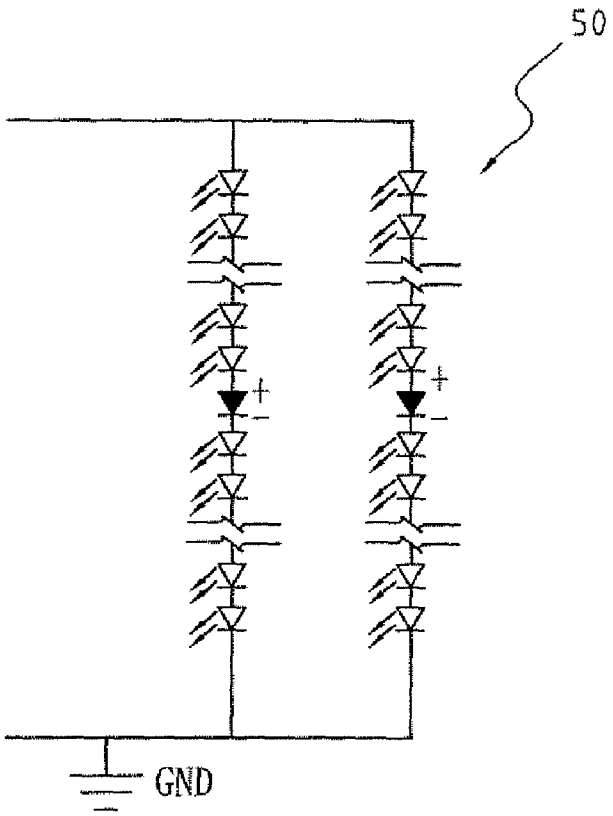
FIG. 5 is a circuit diagram of two sets of two LED arrays connected in series connected in parallel.
Figure 6:
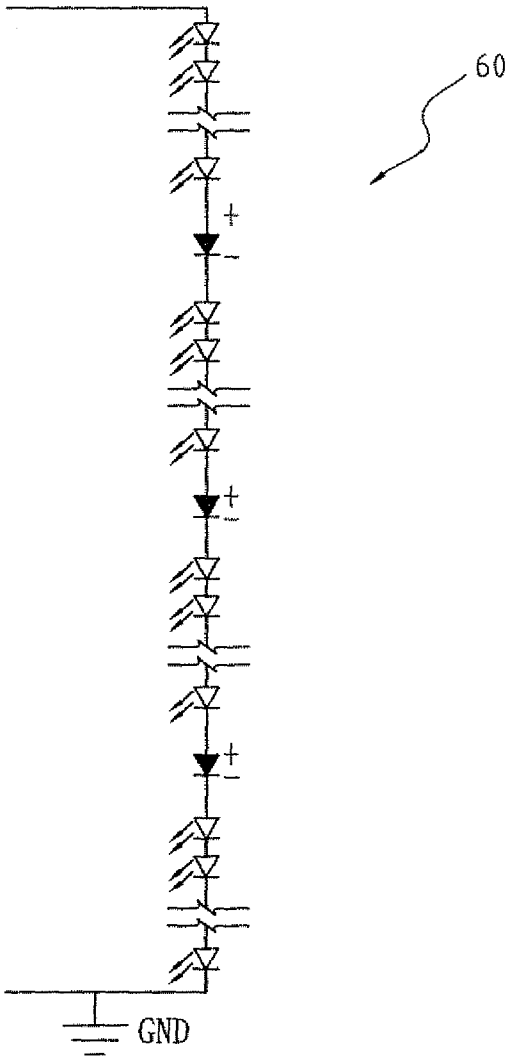
FIG. 6 is a circuit diagram of one set of four LED arrays connected in series.

With further reference to FIGS. 4 to 6, at least one switch pair is connected respectively to the anode and cathode of a dividing diode (25), has a CLOSED state and an OPEN state that configures LED arrays (20) in at least one LED array set (40, 50, 60) and each switch pair comprises a first switch (SWA, SW1A, SW3A, SW3A) and a second switch (SWB, SW1B, SW2B, SW3B).

Each LED array set (40, 50, 60) comprises at least one LED array (20) and drops a voltage across each LED array (20). The voltage drop is corresponding to a summation of the threshold voltages of the LEDs in the LED array (20).

For examples, four LED arrays (40) are connected in parallel when the first and second switches (SW1A, SW1B) of the switch pair ( ) is in the CLOSED state and each LED array set (40) comprises one LED array (20). Two LED array sets (50) are connected in parallel when the first and second switches (SW2A, SW2B) of the switch pair (SW2) is in the CLOSED state and each LED array set (50) comprises two LED arrays (20). One LED array set (60) is formed when the first switch (SWA, SW1A, SW3A, SW3A) and the second switch (SWB, SW1B, SW2B, SW3B) of the three switch pairs are simultaneously in the OPEN state and the LED array set (60) comprises four LED arrays (20).

The first switch (SWA, SW1A, SW3A, SW3A) is connected between the cathode of the dividing diode (25) and the power module (21). The second switch (SWB, SW1B, SW2B, SW3B) is connected between the anode of the dividing diode (25) and ground (GND).

The first and second switch (SWA, SW1A, SW3A, SW3A, SWB, SW1B, SW2B, SW3B) may be mechanical-type switches or transistor-type switches.

The voltage sensing module (23) senses the pulsating DC voltage from the power module (21), is connected to the switch pairs, controls the CLOSED state and the OPEN state of the switch pairs and comprises a rectified input (231), at least one reference voltage input (232) and at least one output (233).

Figure 7:
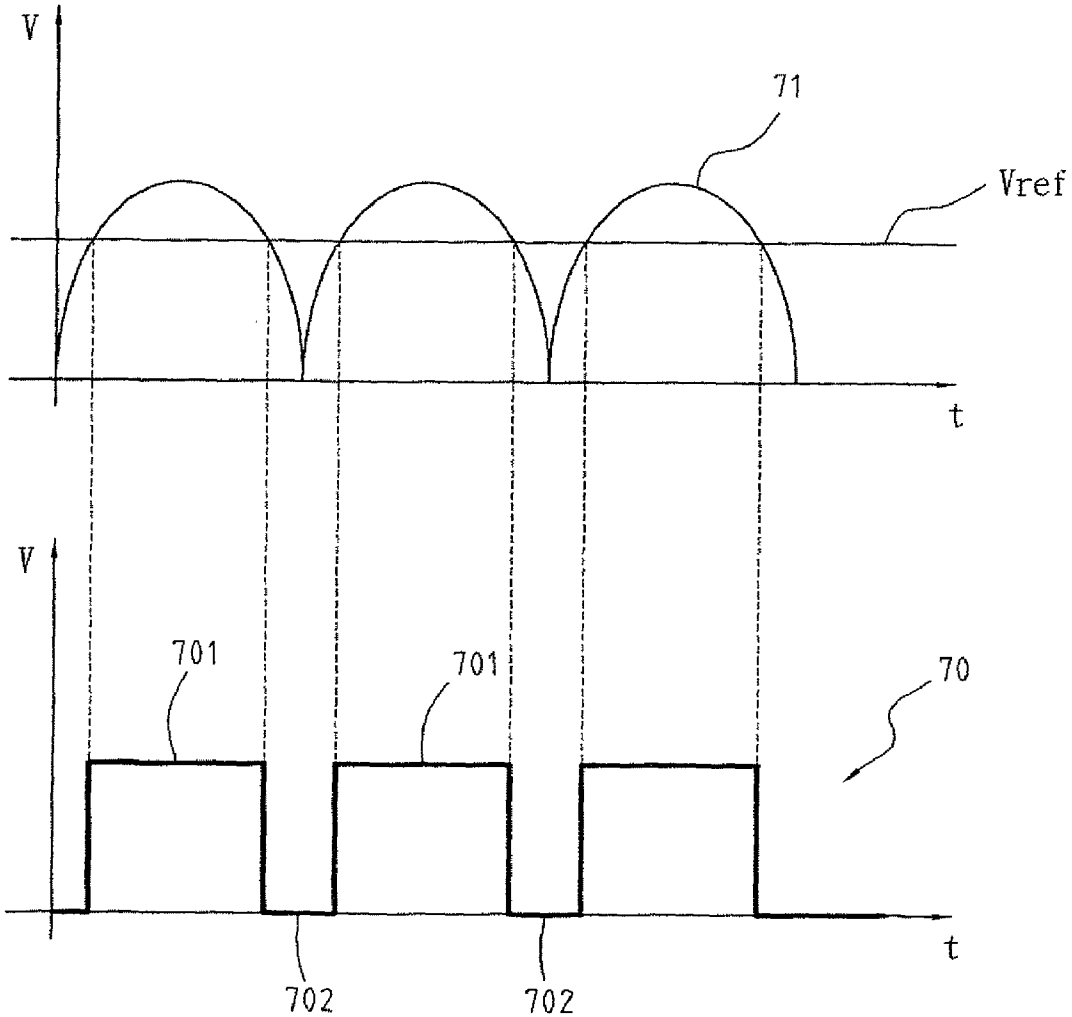
FIG. 7 is a diagram of a control signal that corresponds to the reference voltage.

With further reference to FIG. 7, the rectified input (231) is connected to the power module (21) and receives the pulsating DC voltage (71).

The reference voltage input (232) has a predetermined reference voltage ($V_{ref}$). The reference voltage ($V_{ref}$) corresponds to the voltage drop of the LED array set (40, 50, 60) and may be obtained from an external DC power source.

The outputs (233) have a control signal (70) respectively that corresponds to the switch pair.

The control signal (70) is a clipped form of the reference voltage ($V_{ref}$) corresponding to the pulsating DC voltage (71) and comprises a high voltage potential segment (701) and a low voltage potential segment (702).

The high voltage potential segment (701) OPENs the corresponding switch pairs when the pulsating DC voltage (71) is greater than the reference voltage ($V_{ref}$).

The low voltage potential segment (702) of the control signal (70) CLOSEs the corresponding switch pairs when the pulsating DC voltage (71) is smaller than the reference voltage ($V_{ref}$).

An LED driving method of the present invention comprises acts of initialization, sensing voltage and changing electrical configuration.

The act of initialization sets multiple voltage drops and at least one reference voltage. The voltage drop is a driving voltage of an LED array. The reference voltage is corresponding to the corresponding voltage drops.

The act of sensing voltage senses an incoming voltage to compare with the reference voltage.

The act of changing electrical configuration changes ways of connection of LED arrays based on the reference voltage and the incoming voltage, which makes the incoming voltage higher than the driving voltage of each LED array.

Therefore, the LED driver and the driving method in accordance with the present invention change electrical configuration of the LED arrays to drive all LEDs at different voltage levels, which achieves the highest performance.

People skilled in the art will understand that various changes, modifications, and alterations in form and details may be made without departing from the spirit and scope of the invention.

What is claimed is:

1. An LED driving device comprising a ground;

multiple LED arrays, each LED array comprising multiple LEDs connected in series, and each LED having a threshold voltage;

at least one dividing diode being mounted between adjacent LED arrays and having an anode and a cathode;

a power module being connected to an external power source providing alternating current (AC) power being sinusoidal and having alternating negative and positive segments and the power module having a rectifier inverting the negative segments of the AC power to positive segments and forming a pulsating direct current (DC) voltage;

a driving module being connected to the power module, receiving a pulsating DC voltage from the power module and outputting a constant current to the LED arrays; and at least one switch pair being connected respectively to the anode and cathode of a dividing diode, having a CLOSED state and an OPEN state that configure LED arrays in at least one LED array set; and a voltage sensing module sensing the pulsating DC voltage from the power module, being connected to the switch pairs, closing, opening the switch pairs and comprises a rectified input being connected to the power module and receiving the pulsating DC voltage;

at least one reference voltage input having a predetermined reference voltage corresponding to the voltage drop of the LED array set; and at least one output, each output having a control signal that corresponds to the switch pair;

wherein the control signal comprises a high voltage potential segment opening the corresponding switch pairs when the pulsating DC voltage is greater than the reference voltage; and a low voltage potential segment closing the corresponding switch pairs when the pulsating DC voltage is smaller than the reference voltage.

2. The LED driver as claimed in claim 1, wherein each switch pair comprises a first switch being connected between the cathode of the dividing diode and the power module; and a second switch being connected between the anode of the dividing diode and ground.

3. The LED driver as claimed in claim 2, wherein each LED array set comprises at least one LED array that dropping a voltage across each LED array and the voltage drop being corresponding to a summation of the threshold voltages of the LEDs in the LED array.

4. The LED driver as claimed in claim 2, wherein the first switch and the second switch are mechanical-type switches or transistor-type switches.

5. The LED driver as claimed in claim 1, wherein the reference voltage is obtained from an external DC power source.

6. The LED driver as claimed in claim 1, wherein the driving module is a current restrictor.

* * * * *